US008141919B2

(12) United States Patent
Turdo

(10) Patent No.: US 8,141,919 B2
(45) Date of Patent: Mar. 27, 2012

(54) NESTABLE BALL RETRIEVAL AND STORAGE DEVICE

(75) Inventor: Christina E. Turdo, Evanston, IL (US)

(73) Assignee: CET Tennis Enterprises, LLC, Highland Park, IL (US)

( * ) Notice: Subject to any disclaimer, the term of this patent is extended or adjusted under 35 U.S.C. 154(b) by 530 days.

(21) Appl. No.: 12/043,702

(22) Filed: Mar. 6, 2008

(65) Prior Publication Data

US 2009/0224560 A1 Sep. 10, 2009

Related U.S. Application Data

(63) Continuation-in-part of application No. 12/007,637, filed on Jan. 14, 2008.

(51) Int. Cl.
*A63B 47/02* (2006.01)

(52) U.S. Cl. ..... 294/19.2

(58) Field of Classification Search ..... 294/19.2; 206/315.9; 414/439
See application file for complete search history.

(56) References Cited

U.S. PATENT DOCUMENTS

| | | | | |
|---|---|---|---|---|
| 2,639,163 | A | 5/1953 | Walker | |
| 2,835,099 | A | 5/1958 | Touchberry | |
| 3,323,673 | A * | 6/1967 | Cowan | 217/5 |
| 3,392,874 | A * | 7/1968 | Peebles | 206/514 |
| 3,587,915 | A * | 6/1971 | Theobald et al. | 206/201 |
| 3,926,465 | A * | 12/1975 | Hoagland et al. | 294/19.2 |
| 4,461,504 | A * | 7/1984 | Perez et al. | 294/19.2 |
| 4,534,130 | A * | 8/1985 | Rogers | 47/65.5 |
| 5,301,991 | A | 4/1994 | Chen et al. | |
| 5,464,262 | A | 11/1995 | Madrazo | |
| 5,660,784 | A | 8/1997 | Cruce et al. | |
| 5,860,658 | A | 1/1999 | Callahan | |
| 6,039,205 | A * | 3/2000 | Flink | 220/659 |
| 6,142,544 | A | 11/2000 | Benzoni et al. | |

(Continued)

FOREIGN PATENT DOCUMENTS

DE 75 36 047 U 4/1976

OTHER PUBLICATIONS

TennisPlaza.com, Gamma Bailhopper Pro 85, 2008.

(Continued)

*Primary Examiner* — Saul Rodriguez
*Assistant Examiner* — Stephen Vu
(74) *Attorney, Agent, or Firm* — Banner & Witcoff, Ltd.

(57) ABSTRACT

A nestable ball retrieval and storage device for collecting balls from the ground is provided. The device includes a receptacle and a handle connected to the receptacle. The receptacle has a bottom grate with a plurality of elongated members spaced apart from one another by a distance slightly less than a diameter of a ball to define at least one bottom opening through which a compressed ball on the ground can be forced through. The receptacle further has a receptacle wall structure surrounding and connected to the bottom grate. The receptacle wall structure has an open top and converges inwardly from the open top to the bottom grate to establish a tapering cavity shaped to permit nesting therein of another device that is substantially identical to the ball retrieval and storage device. The handle is constructed and arranged to extend through a bottom opening defined by elongated members of a bottom grate of the other device when the other device is nesting in the tapering cavity of the ball retrieval and storage device.

15 Claims, 6 Drawing Sheets

U.S. PATENT DOCUMENTS

| | | | | |
|---|---|---|---|---|
| 6,302,460 | B1 | 10/2001 | Carr | |
| 6,352,269 | B1 | 3/2002 | Chinigo | |
| 6,354,643 | B1 | 3/2002 | Podejko | |
| 6,412,839 | B1 * | 7/2002 | Tran | 294/19.2 |
| 6,662,748 | B1 * | 12/2003 | Hanks | 119/170 |
| 6,883,844 | B2 | 4/2005 | Carr | |
| 6,926,328 | B2 | 8/2005 | Hellerson | |
| 6,945,578 | B2 | 9/2005 | Hellerson | |
| 2004/0227365 | A1 | 11/2004 | Hellerson | |
| 2006/0103087 | A1 * | 5/2006 | Alcala Sebastian | 280/47.26 |
| 2009/0179443 | A1 | 7/2009 | Turdo | |

OTHER PUBLICATIONS

Gamma, Pickups & Carts, Ball Baskets, Items 1 to 12; http://www.gammasports.com (printed Jan. 30, 2010), 2009.

* cited by examiner

NESTABLE BALL RETRIEVAL AND STORAGE DEVICE

CROSS-REFERENCE TO RELATED APPLICATION(S)

This application is a continuation-in-part of U.S. patent application Ser. No. 12/007,637 filed in the U.S. Patent & Trademark Office on Jan. 14, 2008, the complete disclosure of which is incorporated herein by reference.

FIELD OF THE INVENTION

The present invention relates to ball retrieval and storage devices which are nestable with one another and, more particularly, ball retrieval and storage devices possessing handles which remain operative for pulling or carrying purposes when multiple devices are nested with one another.

BACKGROUND OF THE INVENTION

Ball retrieval and storage devices are particularly useful during tennis practice sessions to collect tennis balls off the ground for storage in a cavity of the device. Some devices are designed to permit ball collection without requiring the operator to reach all the way to the ground to pick up the tennis balls. For example, the bottoms of the devices may be equipped with openings designed to capture tennis balls on the ground when the devices are placed over the balls and pressed downward. The devices may be further equipped with a handle for the operator to grasp and apply the downward force. The downward force of the device compresses a ball and forces it through the opening and into the cavity.

Generally, conventional tennis ball retrieval and storage devices are not nestable with one another. The device handles prevent the devices from stably nesting in one another in a stacked relationship. As a consequence, the devices must be transported, e.g., carried, separately from one another, making it difficult for an operator to transport by hand more than two devices at any one time. The inability to nest the devices also adds to storage space requirements.

U.S. Pat. No. 6,302,460 discloses a sports ball retrieval and storage device purported to permit receptacles of multiple devices to nest with one another. The device includes a pair of support members convertible between a stand position and a handle position. In the handle position, however, the support members obstruct the receptacles from nesting with one another.

SUMMARY OF THE INVENTION

According to a first aspect of the invention a nestable ball retrieval and storage device for collecting balls from the ground, featuring a receptacle and a handle connected to the receptacle. The receptacle includes a bottom grate with a plurality of elongated members spaced apart from one another by a distance slightly less than a diameter of a ball to define at least one bottom opening through which a compressed ball on the ground can be forced through. The receptacle further includes a receptacle wall structure surrounding and connected to the bottom grate. The receptacle wall structure has an open top and converges inwardly from the open top to the bottom grate to establish a tapering cavity shaped to permit nesting therein of another substantially identical ball retrieval and storage device. The handle is constructed and arranged to extend through a bottom opening defined by elongated members of a bottom grate of the other device when the other device is nesting in the tapering cavity of the ball retrieval and storage device.

A second aspect of the invention provides a nestable ball retrieval and storage device for collecting balls from the ground, featuring a receptacle, a handle connected to the receptacle, and wheels connected to the receptacle. The receptacle includes a bottom grate with a plurality of elongated members spaced apart from one another by a distance slightly less than a diameter of a ball to define at least one bottom opening through which a compressed ball on the ground can be forced through. The receptacle further includes a receptacle wall structure surrounding and connected to the bottom grate. The receptacle wall structure has an open top and converges inwardly from the open top to the bottom grate to establish a tapering cavity shaped to permit nesting therein of another substantially identical ball retrieval and storage device. The handle is constructed and arranged to extend through a bottom opening defined by elongated members of a bottom grate of the other device when the other device is nesting in the tapering cavity of the ball retrieval and storage device. The wheels permit rolling movement of the receptacle across the ground.

A third aspect of the invention provides a method of retrieving balls from the ground and storing the balls. According to the method, a device is provided which includes a receptacle and a handle connected to the receptacle. The receptacle has a bottom grate with a plurality of elongated members spaced apart from one another by a distance slightly less than a diameter of a ball to define at least one bottom opening. The receptacle also has a receptacle wall structure surrounding and connected to the bottom grate. The receptacle wall structure has an open top and converges inwardly from the open top to the bottom grate to establish a tapering cavity shaped to permit nesting therein of another substantially identical ball retrieval and storage device. The handle is constructed and arranged to extend through a bottom opening defined by elongated members of a bottom grate of the other device when the other device is nesting in the tapering cavity of the ball retrieval and storage device. According to the method, the device is placed over a ball on the ground, and pressed downward on the handle to compress the ball and force the ball through the bottom opening into the cavity.

According to a fourth aspect of the invention, a method is provided for nesting ball retrieval and storage devices for collecting balls from the ground with one another. The method features providing first and second devices. The first device includes a first receptacle and a first handle connected to the first receptacle, the first receptacle having a first bottom grate with a plurality of first elongated members spaced apart from one another by a distance slightly less than a diameter of a ball to define at least one first bottom opening through which a compressed ball on the ground can be forced through. The first receptacle also has a first receptacle wall structure surrounding and connected to the first bottom grate. The first receptacle wall structure has a first open top and converges inwardly from the first open top to the first bottom grate to establish a first tapering cavity. The second device includes a second receptacle and a second handle connected to the second receptacle, the second receptacle having a second bottom grate with a plurality of second elongated members spaced apart from one another by a distance slightly less than the diameter of the ball to define at least one second bottom opening through which the compressed ball on the ground can be forced through. The second receptacle also has a second receptacle wall structure surrounding and connected to the second bottom grate, the second receptacle wall structure has a second open top and converges inwardly from the second open top to the second bottom grate to establish a second tapering cavity shaped to permit nesting of the first receptacle in the second cavity. According to the method, the second handle is inserted through an opening of the first bottom grate, and the first receptacle is nested in the second cavity while the second handle extends through the opening of the first bottom grate.

Additional aspects of the invention will become apparent upon viewing the accompanying drawings and reading the detailed description below.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

Figure 1:
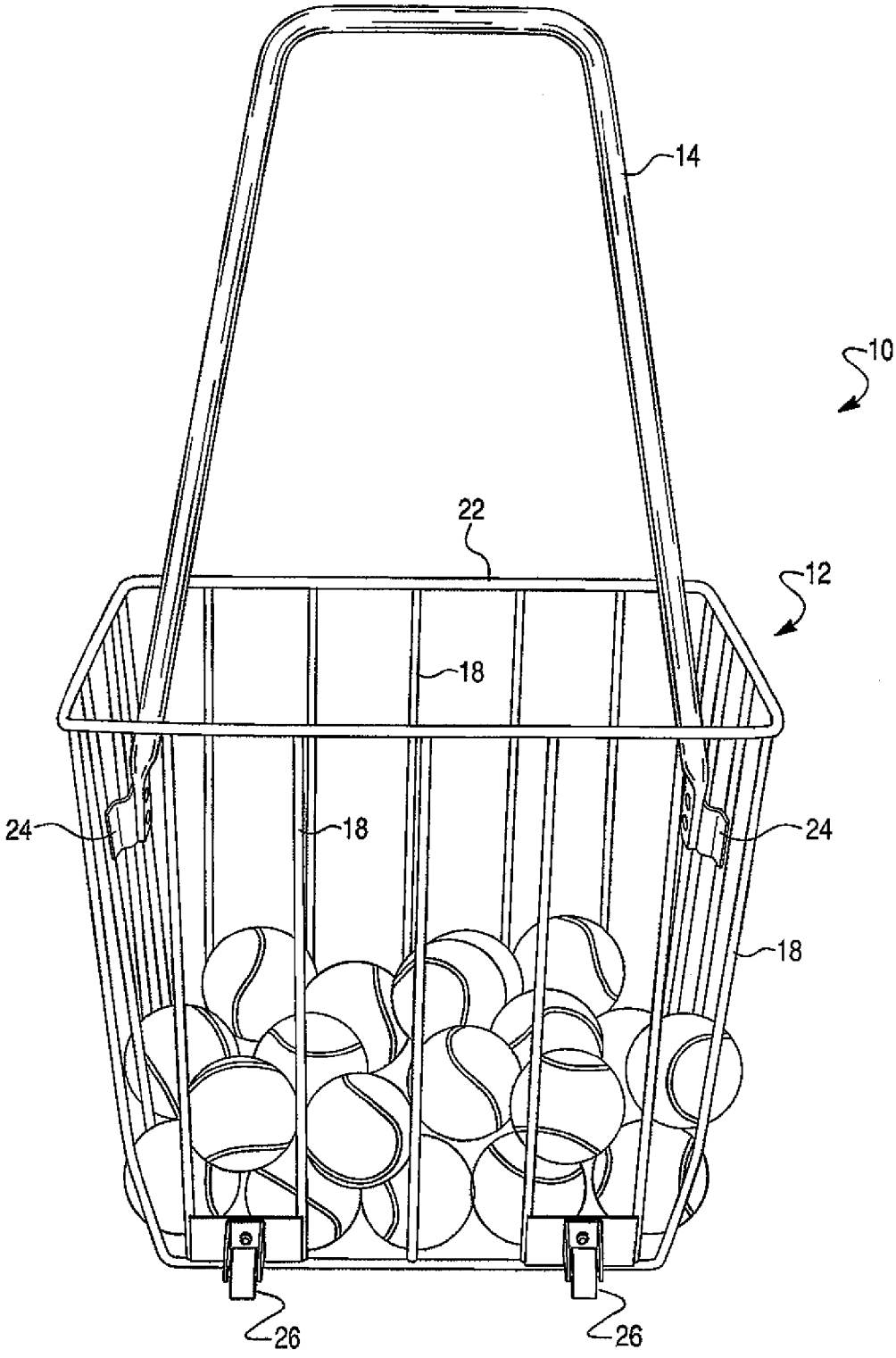
FIG. 1 is a front view of nestable ball retrieval and storage device according to an embodiment of the invention, in which the device includes tennis balls.

DETAILED DESCRIPTION OF EXEMPLARY EMBODIMENTS AND EXEMPLARY METHODS OF THE INVENTION

Reference will now be made in detail to preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods.

Figure 2:
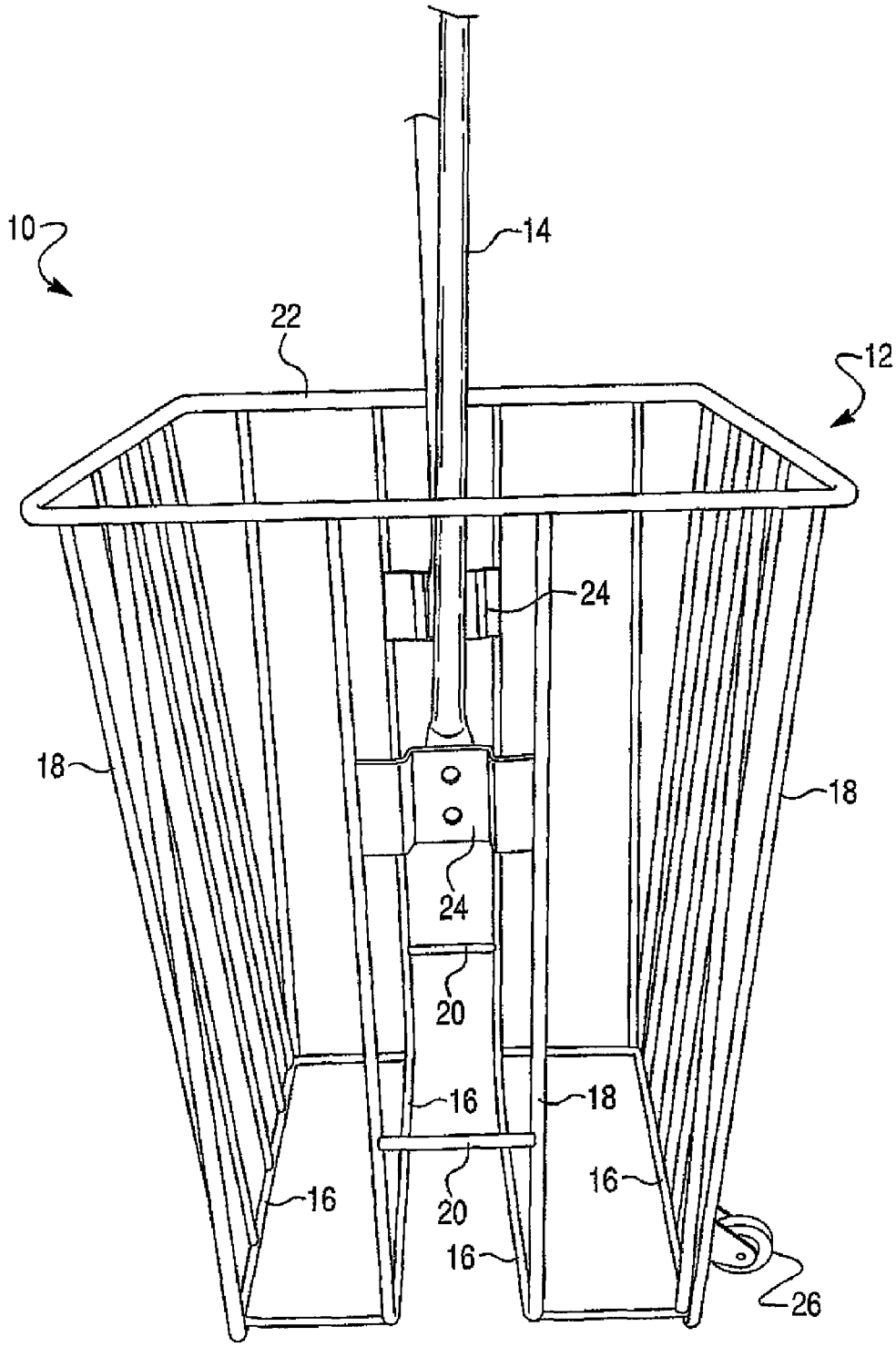
FIG. 2 is an end view of the device of FIG. 1, without tennis balls.

Referring more particularly to the drawings, a nestable ball retrieval and storage device for collecting balls from the ground is generally illustrated by reference numeral 10. As best shown in FIGS. 1 and 2, device 10 includes a receptacle 12 and a handle 14 which is directly or indirectly connected to receptacle 12.

Receptacle 12 is embodied as a bottom grate 16 and a receptacle wall structure 18 surrounding and connected to bottom grate 16. Bottom grate 16 and receptacle wall structure 18 may be integrally connected to one another to provide a single-piece construction. Alternatively, the connection between bottom grate 16 and receptacle wall structure 18 may be established by, for example, mechanical fasteners or welding. Bottom grate and receptacle wall structure 18 may be made of any suitable material for carrying out the intended ball retrieval and storage uses of device 10. Representative materials include metals (e.g., aluminum) and alloys (e.g., steel), plastics, and composites, and combinations thereof.

Bottom grate 16 includes a plurality of elongated members. At least two of the elongated members are spaced apart from one another by a distance slightly less than a diameter of a ball, such as a tennis ball, to define a bottom opening through which the ball may be compressed and forced through. Optionally, three, four, or more (e.g., all) of the elongated members are spaced apart from one another to define multiple bottom openings through which compressed balls may be forced.

Receptacle wall structure 18 is embodied in the figures as having two opposite end walls connected to one another by two opposite side walls to define a cavity. The opposite end walls are depicted as continuing extensions of the elongated members of bottom grate 16 extending generally upward from opposite lower edges of bottom grate 16. Referring to the continuing extensions of bottom grate 16 which define the central bottom opening through which balls are collected, there are no cross-sectional members along the central bottom opening or at its opposite ends that would materially interfere with nestability of device 10 with another substantially identical device. Reinforcing segments 20 between the continuing extensions are sufficiently high on the end walls of wall structure 18 so as to provide reinforcement without materially impairing stackability.

The side walls of receptacle wall structure 18 are embodied as elongated members extending upward from either of the outermost elongated members of bottom grate 16. The upper ends of the elongated members defining the opposite end walls and side walls terminate at a rim 22 at the upper edge of receptacle wall structure 18. Rim 22 defines an open top through which balls may be loaded into and unloaded from the cavity. The end and side walls of receptacle wall structure 18 converge inwardly from rim 22 to bottom grate 16 to taper the cavity.

Handle 14 is connected to receptacle 12. The connection may be direct, indirect, integral, permanent, or temporary. In the illustrated embodiment, the opposite end walls of receptacle wall structure 18 each is equipped with a bracket 24 attached to adjacent elongated members. Brackets 24 are spaced below rim 22 to facilitate stacking. Optionally, brackets 24 serve as pivot joints for permitting pivotal movement of handle 14 forward and backwards towards and away from the opposite side walls of receptacle wall structure 18. Alternatively, brackets 24 may render handle 14 stationary and immovable relative to receptacle wall structure 18. Handle 14 may be made of, for example, metals, alloys, plastic, and/or composites, and may be the same material or a different material than receptacle 12. Generally, handle 14 has opposite arms extending upward in the cavity from brackets 24 and passing through the open top defined by rim 22. A horizontally extending gripping segment of handle 14 extends between the arms and provides a central and convenient area at which device 10 may be balanced and carried.

Figure 3:
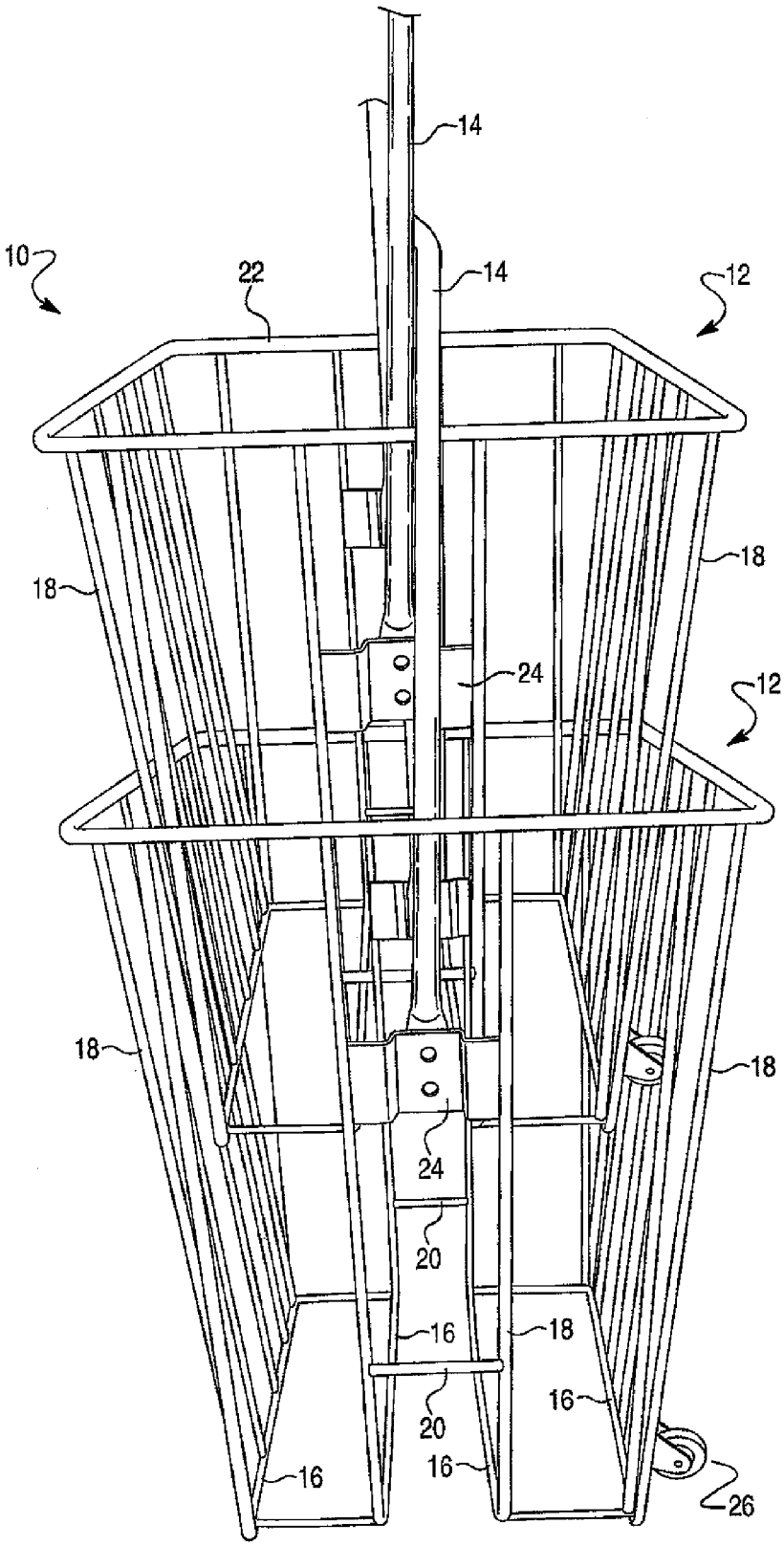
FIG. 3 is another end view of substantially identical devices to FIG. 1 in nesting relationship.
Figure 4:
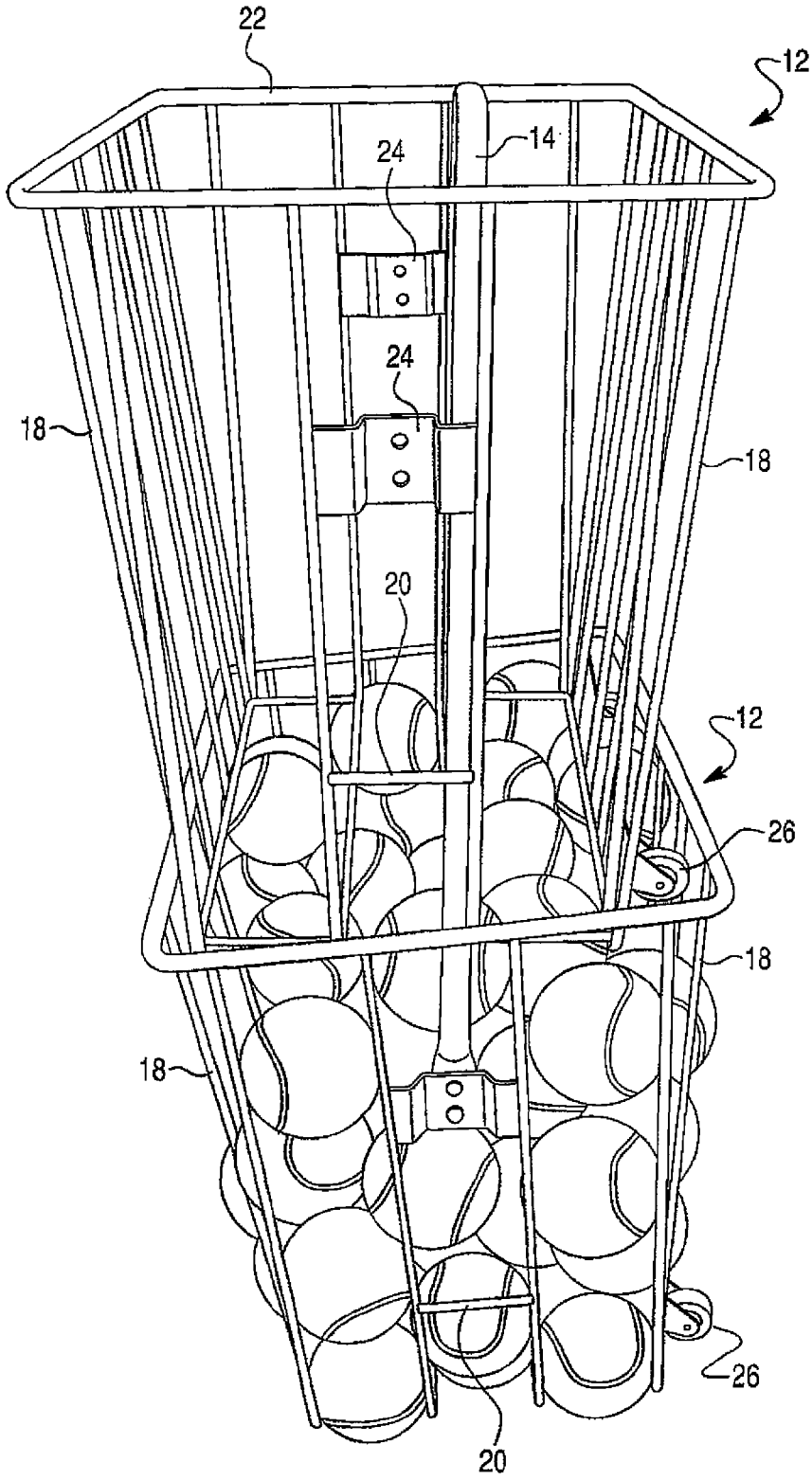
FIG. 4 is another end view similar to FIG. 3, but with tennis balls in the lower device.

As shown in FIGS. 3 and 4, the tapering cavity of receptacle 12 permits for nesting of a plurality of substantially identical devices with one another in stacked relationship. Two, three, four, or more receptacles 12 may be stacked with one another. Advantageously, the nesting and stacking of receptacles 12 facilitates transporting of multiple devices 10. Receptacles 12 may be nested and stacked with one another if their respective cavities are empty or partially filled with balls.

Importantly, handle 14 of a lower stacked device is constructed and arranged to extend through a central bottom opening defined by elongated members of a bottom grate 16 of another substantially identical device stacked thereon to allow nesting of the upper stacked device in the tapering cavity of the lower stacked device. Handle 14 may be either fixed in place or movable, e.g., pivotal, to facilitate protrusion of handle 14 through the bottom opening of bottom grate 16 during nesting. To ensure that handle 14 does not obstruct or otherwise hinder nesting of stacked receptacles, in an exemplary embodiment handle 14 is confined within an area defined by imaginary continuous planes which extends upward from rim 22. If, on the other hand, handle 14 were positioned to extend outside the boundaries of the open top at rim 22, nesting would be impaired. Additionally, there are no crossing members, such as members 20, along the central bottom opening or at the opposite ends of the central bottom opening that would materially interfere with insertion of handle 14 of the lower stacked device through bottom grate 16 of the upper stacked device. Reinforcing segments 20 are sufficiently high on the end walls of wall structure 18 so as to provide reinforcement without materially impairing stackability. Furthermore, the spacing of brackets 24 well below rim 22 lessens the likelihood that the broader opposite arms of handle 14 of a lower device will contact reinforcing segments 20 of an upper device prior to full nesting.

In the illustrated embodiment wheels 26 are connected to receptacle 12 for permitting users of all ages to transport and use device 10. Wheels 26 are shown as separate components each independently attached to receptacle 12. In the illustrated two-wheeled embodiment, the operator tilts device 10 to support the full weight of device 10 on wheels 22, and pushes or pulls on handle 14 to roll device 10 across the ground. Advantageously, multiple devices 10 may be nested with one another and collectively rolled on wheels 26 of the bottommost device. It should be understood that various modifications and variations are possible. Wheels 26 may share a common axel extending along the bottom side edge of receptacle. Alternatively, wheels 26 may be embodied as castors. Device 10 also may contain more than two wheels so as to permit rolling movement of device 10 without tilting.

In use, device 10 is used for the storage of balls, such as tennis balls. In a practice environment, as needed the balls are removed from the top opening of device 10 for serving or hitting. When the cavity is at or near empty, device is transported around the tennis court and placed over balls resting on the ground. The user presses downward on handle 14 to compress a tennis ball and force the ball through the bottom opening and into the cavity of device 10. Hence, balls may be collected without requiring the user to bend over and individually pick up the balls from the ground. This feature is especially beneficial to elder users. The user then transports device 10 over another ball and repeats the procedure until the balls are collected from the ground.

Empty or filled devices 10 may be stacked with one another by positioning a first device over a second device, and maneuvering the upper first device to insert the handle of the lower second device through the opening in the bottom grate of the upper first device. The receptacle of the upper first device is thereby nested in the cavity of the lower second device with the handle of the second lower device extending into the cavity of the upper first device. Advantageously, the position and arrangement of the respective handles of the upper first device and lower second device does not impede nestability.

Devices 10 may be made using fabrication devices and techniques well known in the art without undue experimentation.

Modifications and variations to the illustrated embodiments may be implemented within the scope of the invention. For example, device 10 may be provided in multiple sizes to accommodate users of different ages and needs. Device also may be provided with multiple detachable handles of different sizes for accommodating different users. For instance, when an adult is using device 10, a larger size handle 14 is selected and attached to brackets 24. Large size handle 14 can be detached from brackets 24 and replaced by a smaller size handle (not shown), which attaches to brackets 24.

Figure 5:
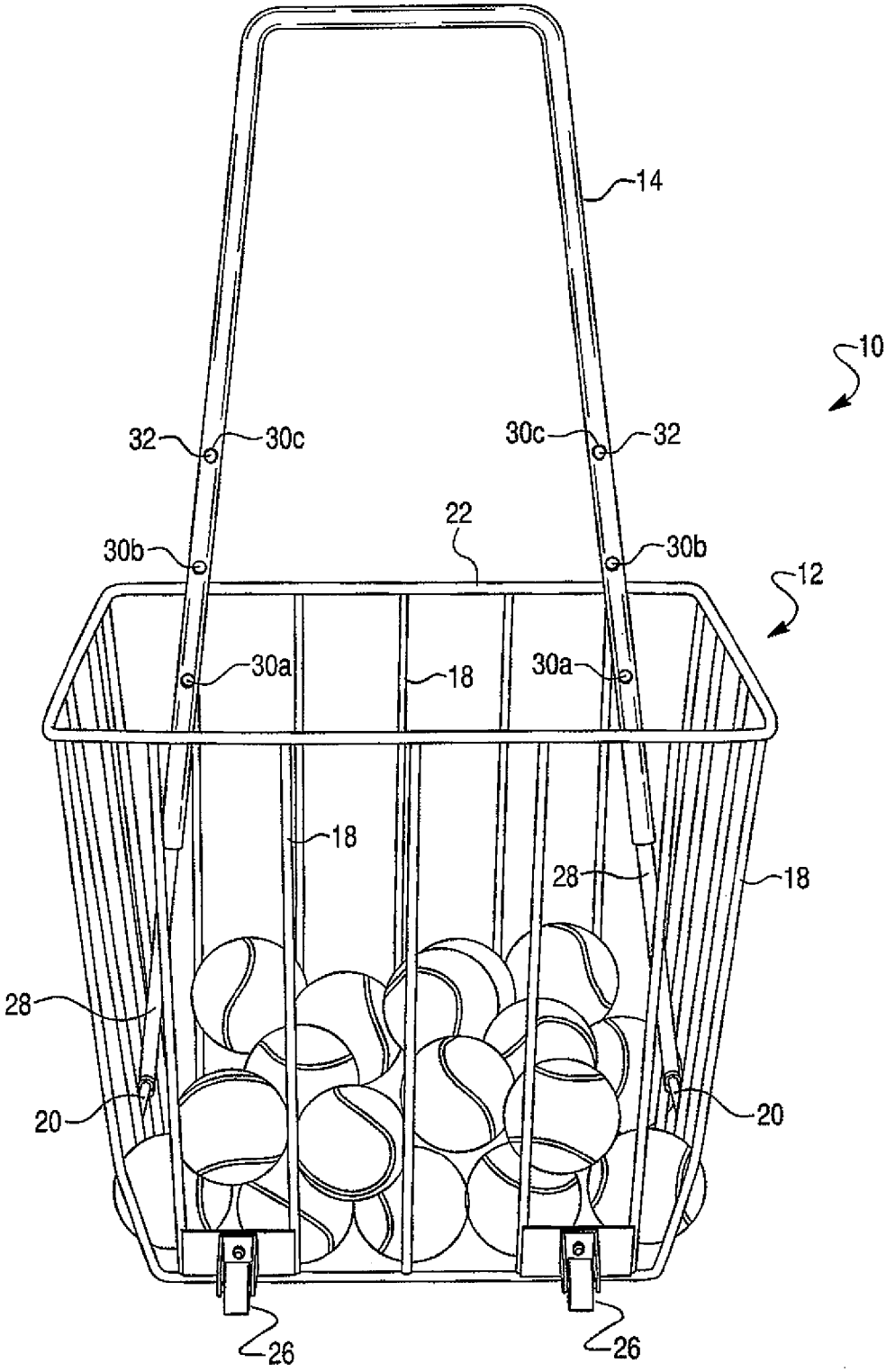
FIG. 5 is a front view of a nestable ball retrieval and storage device according to another embodiment of the invention, in which the device possesses an adjustable handle situated in a lower position.
Figure 6:
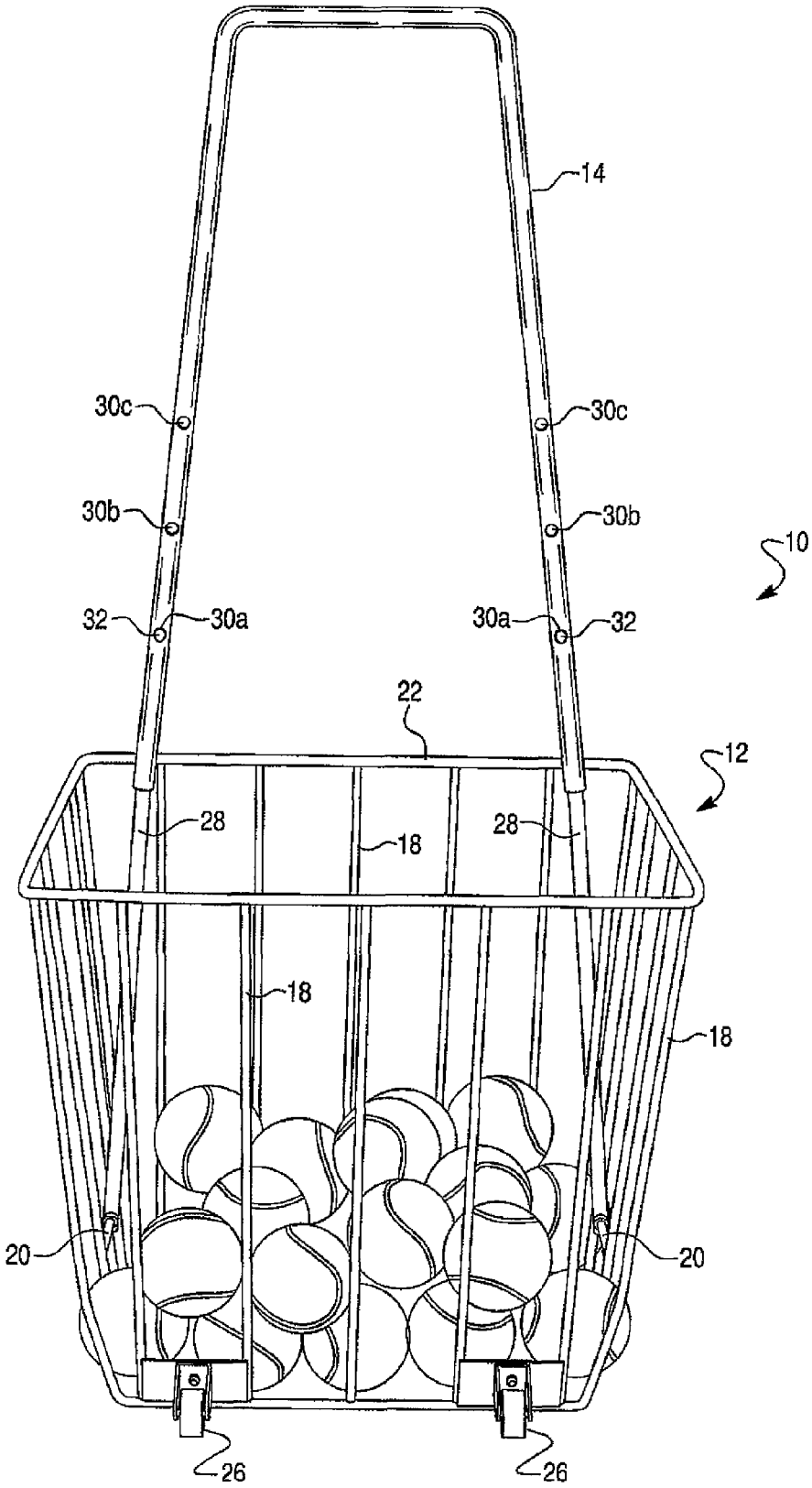
FIG. 6 is a front view of the nestable ball retrieval and storage device of FIG. 5, in which the adjustable handle is shown situated in a raised position.

FIGS. 5 and 6 illustrate a modified embodiment in which handle 14 is movable relative to receptacle 12 to multiple (e.g., 2, 3, 4, or more) different heights. In the illustrated embodiment, the opposite arms of handle 14 each possess a plurality of apertures or holes 30*a*, 30*b*, 30*c* spaced along their length. The opposite arms of handle 14 telescopically receive respective sleeves 28. The lower ends of sleeves 28 are fixedly connected to reinforcing segments 20 on opposite ends of receptacle 12. The connection between sleeves 28 and reinforcing segments 20 may allow for movement, such as pivoting or flexure, of sleeves 28. The upper ends of sleeves 28 each include a connector 32 for adjustably mating sleeves 28 to the opposite arms of handle 14. In the illustrated embodiment, connector 32 is a spring-loaded button or pin, such as sold under the trademark VALCO, biased outward and sized to fit through apertures 30 for locking handle 14 at a selected height. FIG. 5 illustrates handle 14 in its lowermost position, in which connectors 32 protrude through the uppermost apertures 30*c* to shorten the length of handle 14. FIG. 6 illustrates handle 14 in its uppermost position, in which connectors 32 protrude through lowermost apertures 30*a* to extend the length of handle 14 to a maximum.

The position/height of handle 14 may be adjusted by pressing connectors 32 inward relative to sleeves 28. Connectors 32 disengage from apertures 30*a*, 30*b*, or 30*c* to release the arms of handle 14 from sleeve 28. The arms are then telescopically slidable along the length of sleeves 28 until the spring bias of the spring loaded button 32 urges button into locking engagement with another one of apertures 30*a*, 30*b*, or 30*c*. In this manner, handle 14 may be adjusted to the lowered and raised height positions shown in FIGS. 5 and 6, respectively, and to an intermediate height position in which spring-loaded buttons 32 extend through middle apertures 30*b*. It should be understood that additional apertures may be provided to in the arms of handle 14 to establish additional height positions. It should further be understood that alternative connectors or fasteners may be used. For example, while FIGS. 5 and 6 illustrate a spring-loaded button for selecting between interval handle height adjustments, the selected connector or fastener may permit continuous variable handle height selection, i.e., at any height along the length of sleeves 28.

The foregoing detailed description of the certain preferred embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims and their appropriate equivalents.

What is claimed is:

1. A nestable ball retrieval and storage device for collecting balls from the ground, comprising:

a receptacle, comprising a bottom grate comprising a plurality of elongated members joined by crossing members such that the elongated members are spaced apart from one another by a distance slightly less than a diameter of a ball to define at least one bottom opening through which a compressed ball on the ground can be forced through, said bottom grate further having a central area that is void of said elongated members and crossing members to form a bottom void opening; and a receptacle wall structure surrounding and connected to the bottom grate, the receptacle wall structure having an open top and converging inwardly from the open top to the bottom grate to establish a tapering cavity shaped to permit nesting therein of another device that is substantially identical to the ball retrieval and storage device; and a handle connected to the receptacle and extended above said open top of the receptacle wall structure, the handle constructed and arranged to extend through a bottom void opening defined by elongated members of a bottom grate of said another device when said another device is nesting in the tapering cavity of the ball retrieval and storage device.

2. The device of claim 1, wherein the distance by which the elongated members are spaced apart is slightly less than a diameter of a tennis ball.

3. The device of claim 1, wherein the elongated members define multiple bottom openings through which compressed tennis balls can be forced through into the tapered cavity.

4. The device of claim 1, wherein the receptacle wall structure comprises opposite end walls interconnected to opposite side walls and crossing members on at least one of said pair of opposed sidewalls are positioned above said at least one bottom opening of the bottom grate.

5. The device of claim 1, wherein the handle is connected to opposite sides of the receptacle wall structure and extends between the opposite sides of the receptacle wall structure in a direction generally parallel to the elongated members.

6. The device of claim 1, wherein said at least one bottom opening of the bottom grate is defined by an area that is free of any elongated members or any crossing members along the entire length of said elongated members of the bottom grate.

7. The device of claim 1, wherein the handle is telescopically adjustable to different heights.

8. A nestable ball retrieval and storage device for collecting balls from the ground, comprising:

a receptacle, comprising a bottom grate comprising a plurality of elongated members joined by crossing members such that the elongated members are spaced apart from one another by a distance slightly less than a diameter of a ball to define at least one bottom opening through which a compressed ball on the ground can be forced through, and said bottom grate further having an area that is absent of elongated members and crossing members to form a bottom void opening; and a receptacle wall structure surrounding and connected to the bottom gate, the receptacle wall structure having an open top and converging inwardly from the open top to the bottom grate to establish a tapering cavity shaped to permit nesting therein of another device that is substantially identical to the ball retrieval and storage device;

a handle connected to the receptacle and extended above said open top of the receptacle wall structure, the handle constructed and arranged to extend through a bottom void opening defined by elongated members of a bottom grate of said another device when said another device is nesting in the tapering cavity of the ball retrieval and storage device; and wheels connected to the receptacle for permitting rolling movement of the receptacle across the ground.

9. The device of claim 8, wherein the wheels are connected to the receptacle wall structure such that the wheels reside above the bottom wall and the receptacle is tiltable into a tilted rolling movement position, and wherein the wheels support the receptacle in the tilted rolling movement position.

10. The device of claim 8, wherein the distance by which the elongated members are spaced apart is slightly less than a diameter of a tennis ball.

11. The device of claim 8, wherein the elongated members define multiple bottom openings through which compressed tennis balls can be forced through into the tapered cavity.

12. The device of claim 8, wherein the receptacle wall structure comprises opposite end walls interconnected to opposite side walls.

13. The device of claim 8, wherein the handle is connected to opposite sides of the receptacle wall structure and extends between the opposite sides of the receptacle wall structure in a direction generally parallel to the elongated members.

14. The device of claim 8, wherein said at least one bottom opening of the bottom grate is defined by an area that is free of any elongated members and free of any crossing members along the entire length of the elongated members of the bottom grate.

15. The device of claim 8, wherein the handle is telescopically adjustable to different heights.

* * * * *